US010124952B2

(12) United States Patent
Williams

(10) Patent No.: US 10,124,952 B2
(45) Date of Patent: Nov. 13, 2018

(54) AEROSOL CAN ACTUATOR LEVER FOR SELECTIVE DISPENSING

(71) Applicant: WILLIAMS COMPANY ENTERPRISES, LLC, Springfield, MO (US)

(72) Inventor: Rick Williams, Springfield, MO (US)

(73) Assignee: Williams Company Enterprises, LLC, Springfield, MO (US)

( * ) Notice: Subject to any disclaimer, the term of this patent is extended or adjusted under 35 U.S.C. 154(b) by 0 days.

(21) Appl. No.: 15/648,968

(22) Filed: Jul. 13, 2017

(65) Prior Publication Data

US 2018/0016086 A1 Jan. 18, 2018

Related U.S. Application Data

(60) Provisional application No. 62/362,480, filed on Jul. 14, 2016.

(51) Int. Cl.
*B65D 83/20* (2006.01)
*B65D 83/24* (2006.01)
*B65D 83/48* (2006.01)

(52) U.S. Cl.
CPC ..... *B65D 83/201* (2013.01); *B65D 83/24* (2013.01); *B65D 83/48* (2013.01)

(58) Field of Classification Search
CPC ..... B65D 83/24; B65D 83/48; B65D 83/201
USPC ..... 222/153.01–153.14, 402.1–402.25, 472
See application file for complete search history.

(56) References Cited

U.S. PATENT DOCUMENTS 2,921,722 A * 1/1960 Focht ..... B65D 83/205 222/337
3,081,918 A * 3/1963 Scoggin, Jr. ..... B65D 83/20 222/402.14
3,137,414 A * 6/1964 Steinkamp ..... B65D 83/205 222/182
3,185,350 A * 5/1965 Abplanalp ..... B65D 83/24 222/402.11
3,539,078 A * 11/1970 Venus, Jr. ..... B65D 83/205 222/153.07
3,642,179 A * 2/1972 Micallef ..... B65D 83/205 222/402.12
3,785,569 A * 1/1974 Helmrich ..... B65D 83/28 102/368
4,219,135 A * 8/1980 Ufferfilge ..... B65D 83/205 222/402.13

(Continued)

*Primary Examiner* — Vishal Pancholi
(74) *Attorney, Agent, or Firm* — Kutak Rock LLP; James H. Jeffries

(57) ABSTRACT

The present disclosure relate to an actuator assembly for an aerosol can. The assembly includes a body attachable to a can and a disc provided with two opposing levers. The disc is hinged to the body and generally overlies a valve provided on the aerosol can. When either lever is depressed, a valve socket on the bottom of the disc engages the valve of the aerosol can to discharge pressurized liquid through a port formed through the disc. One of the levers is provided with a catching member that engages and selectively locks onto a latch provided on the body so that the lever is captured in a depressed position to cause the continuous discharge of liquid from the can. The captured lever can be released to discontinue discharge of liquid by pressing the other lever.

14 Claims, 7 Drawing Sheets

(56) References Cited

U.S. PATENT DOCUMENTS

| | | | | | |
|---|---|---|---|---|---|
| 4,260,080 | A * | 4/1981 | Gailitis | B65D 83/24 | 222/402.14 |
| 4,506,808 | A * | 3/1985 | Goncalves | B65D 83/205 | 222/182 |
| 4,513,890 | A * | 4/1985 | Goncalves | B65D 83/226 | 222/153.06 |
| 4,568,002 | A * | 2/1986 | Weinstein | B65D 83/205 | 222/131 |
| 5,244,128 | A * | 9/1993 | De Laforcade | B65D 83/205 | 222/402.13 |
| 5,649,645 | A * | 7/1997 | Demarest | B65D 83/205 | 222/153.07 |
| 6,126,044 | A * | 10/2000 | Smith | B65D 83/206 | 222/1 |
| 6,708,849 | B1 * | 3/2004 | Carter | B65D 83/20 | 222/153.1 |
| 2013/0320041 | A1 * | 12/2013 | Selinger | B65D 83/206 | 222/153.11 |

* cited by examiner

AEROSOL CAN ACTUATOR LEVER FOR SELECTIVE DISPENSING

CROSS-REFERENCE TO RELATED APPLICATION

This application claims the benefit of priority of U.S. Provisional Ser. No. 62/362,480, filed Jul. 14, 2016, which is herein incorporated by reference in its entirety.

BACKGROUND

The present invention relates to a lever for use on a common aerosol spray can which allows the user to easily select between continuous fogging and selective spraying of pressurized liquid. Aerosol spray actuators are common and vary widely to facilitate spraying of pressurized liquid contained in a can which is dispersed from the can through a tube. Generally, spray actuators are used for directional orientation of a spray pattern dispensed through the nozzle where the liquid is dispersed as long as the actuator is manually activated. Common uses of spray actuators on aerosol cans include the targeted spraying of cleaners, disinfectants, lubricants and paint.

Fogging or misting actuators are often used for atomizing fluids in a large pattern to saturate an area with dispersed fluids. Similar to a spraying actuator, a fogging actuator is generally in fluid communication with pressurized liquid in the can. Many fogging actuators are fitted with a latching device which secures the actuator in the dispensing position so that the entire contents of an aerosol can are dispensed without the user having to continuously depress the actuator or dispensing lever. Common uses of fogging actuators on aerosol cans include dispensing pest killers and disinfectants within a defined area, such a room of a building. A fogging actuator with a latching mechanism is well-suited for such applications so that a user can actuate the fogging actuator to continuously dispense a fluid, such as pesticide, without having to physically depress the actuator and be exposed to harmful spray. However, once a fogging actuators is latched, it is very difficult, and often impossible, to stop the dispersal of fluid. And a user will have constant exposure to the liquid being dispersed until they can unlatch the actuator.

One drawback of the currently available aerosol spray actuators is exclusive functionality of either directional spraying or continuous fogging. Most cans are either provided with a spray actuator or a fogging actuator. This means that a user wanting to spray the entire contents of a can must continuously depress the spray actuator or buy cans with a fogging actuator. Conversely, a user wanting to spray a partial amount of the can contents must either have spray actuator equipped cans or attempt to manually spray with a fogging actuator without locking the actuator into the dispensing position.

The instant invention overcomes these drawbacks and limitations by providing an innovative aerosol can spray actuator that allows the user to selectively spray or intermittently fog from the same pressurized container.

SUMMARY

Embodiments of the present disclosure relate to an actuator for aerosol cans. An aerosol actuator is provided for use on pressurized aerosol cans having a chime, a dome, a valve stem and discharge tube. The actuator has an actuator body with a lower margin defining an actuator in a substantially vertical orientation on the top of the aerosol can. The actuator body has an open, central well with two opposing lever notches extending through the top edge of the actuator body. Within the central well of the actuator body an actuator disk is hinged at one or two edges to the actuator body. It is preferred that the actuator disk be hinged at two opposing sides to the actuator body perpendicular the two lever notches so that the disk can pivot when depressed on either side of the hinges.

The actuator disk has two opposing levers formed integrally with the actuator disk and generally extending outward from the periphery of the disk. The two opposing levers comprise a first or spraying lever and a second or fogging lever. One of the two levers should be larger than the other so that they are visually distinguishable. In the preferred embodiment, the spraying lever is larger than the fogging lever. The levers can also have different colors, textures, images or words to aid a user in visually distinguishing them.

Both the spraying lever and fogging lever extend beyond the actuator body and are generally oriented through the spaces created at the opposing lever slots. The actuator disk extends across the top of the aerosol can and the protruding valve stem, and includes a valve stem guide and valve stem socket on the underside and center of the trigger disk. The valve stem socket is in fluid communication with the discharge nozzle via the valve stem provided on the can.

When actuated by depressing the spraying lever, the spraying lever pivots generally downward to exert force on the valve stem of the aerosol can. This force on the valve stem causes the discharge nozzle to open, thereby releasing the pressurized fluid from the can. When the spraying lever is released it returns to its static position and pressure is removed from the valve stem concurrently stopping the discharge of fluid.

When actuated by depressing the fogging lever, the fogging lever tilts the entire actuator disk which forces the valve stem causing the discharge nozzle to open, thereby releasing the pressurized fluid from the can. On the bottom side of the fogging lever a small, half spherical shaped catching member is provided. A latch is formed at the lever notch oriented generally below the fogging lever and substantially aligned with the catching member. The latch is deformable and bends as the catching member engages the latch as the fogging lever is forced downward into contact with the lever notch. As the latch deforms, the catching member passes below the latch and is captured as the latch returns to its static position. Because the catching member becomes trapped below the latch, the fogging nozzle is maintained in the depressed or active position and the force against the valve stem persists thereby continuously releasing fluid through the discharge nozzle of the can.

Because both the spraying lever and fogging lever are integrally formed with the actuator disk, when one of the levers is depressed, the opposing lever necessarily elevates. Accordingly, when the fogging lever is depressed and the catching member is engaged by and captured under the latch, the spraying lever is elevated. The catching member can be disengaged from the latch by forcing the spraying lever downward which reverses the latching process. The catching member is forced upward by downward pressure on the spraying lever. Sufficient force can be achieved to cause the catching member to slightly deform the latch allowing the catching member to move upward and past the latch, thereby unlatching the fogging lever from the lever notch.

In the event that fogging lever is accidently pushed into the "locked" position, or if a user decides to discontinue fogging after commencing, the fogging lever is unlocked by depressing the spraying lever, as described herein which, in turn, discontinues the expulsion of fluid from the nozzle. This inventive lever assembly allows a user to release controlled amounts of pressurized fluid by using the spraying lever, to release the entire contents of the can by depressing and locking the fogging lever, or prematurely discontinuing the complete discharge of the can by unlocking a fully depressed and locked fogging lever by depressing the spraying lever to disengage the catching member of the fogging lever from the latch.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

Figure 1:
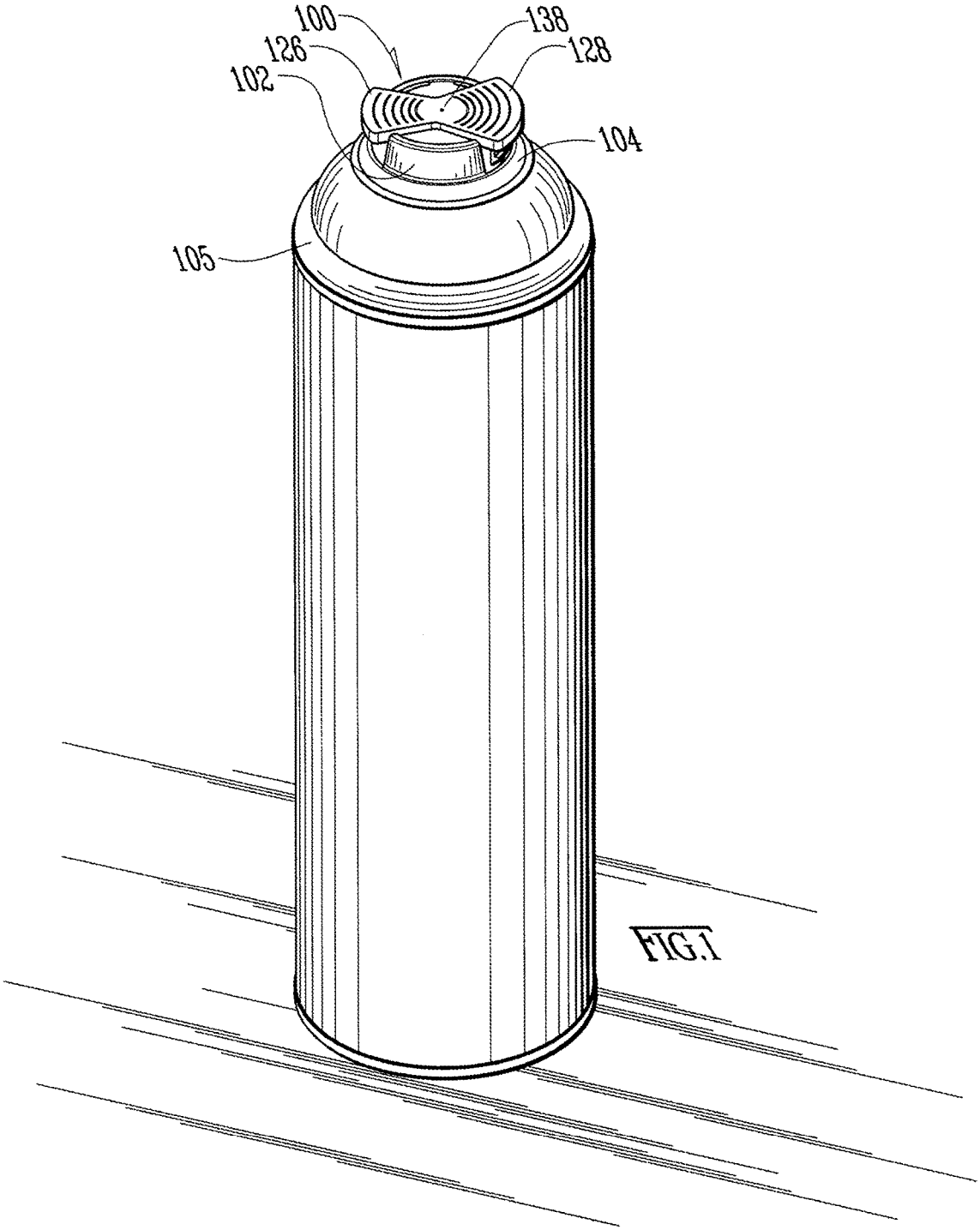
FIG. 1 illustrates a perspective view of the aerosol lever assembly mounted on an aerosol can in accordance with an example embodiment of the present disclosure.
Figure 2:
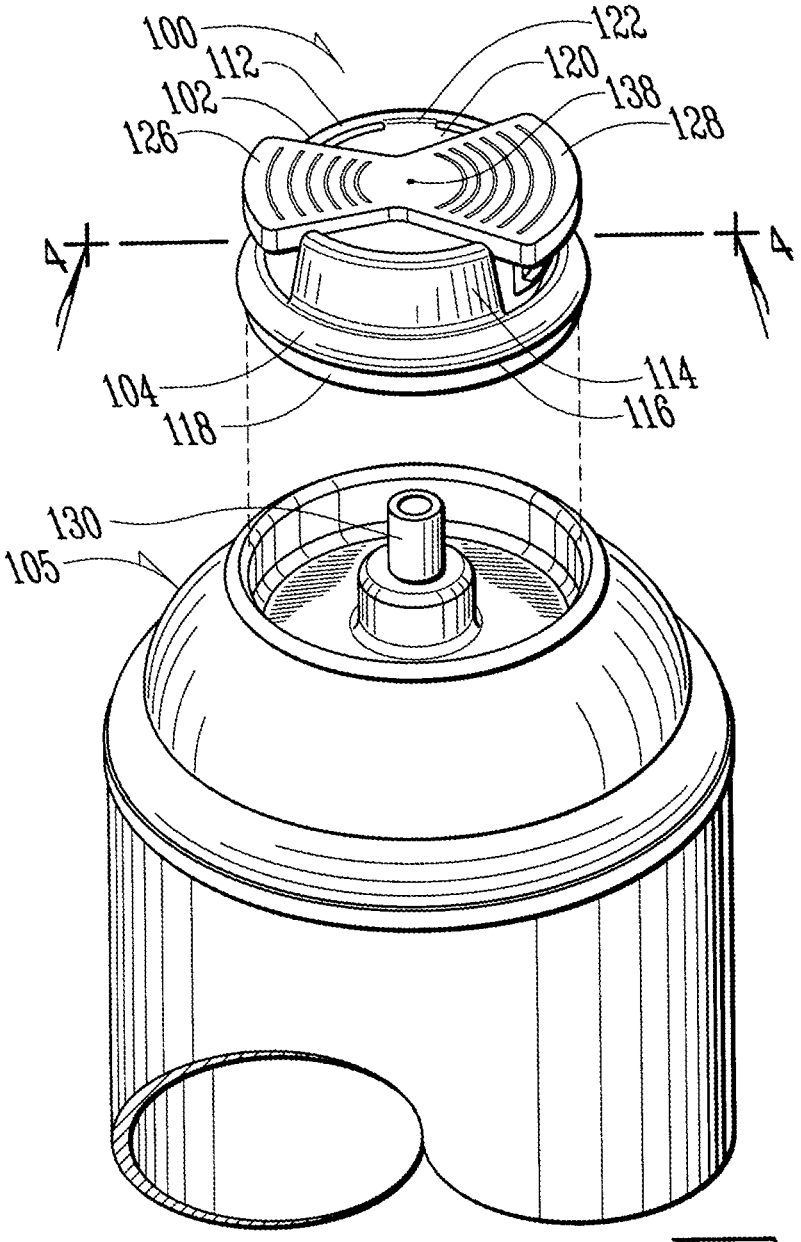
FIG. 2 illustrates a partially exploded perspective view showing the aerosol lever oriented for mounting to an aerosol can.

Referring now generally to the figures, an actuator for aerosol cans is shown and will be described herein. An aerosol actuator is provided for use on common pressurized aerosol cans having common construction to include a chime, a dome, a valve stem and discharge tube. As shown in FIGS. 1 and 2, the actuator 100 has an actuator body 102 with a lower margin 104 in a substantially vertical orientation on the top of the aerosol can 105. The actuator body 102 has an open, central well 106 with two opposing lever notches 108, 110 extending through the periphery of a top edge 112 and sidewall 114 of the actuator body 102. A mounting collar 116 and mounting skirt 118 may be formed at the lower portion of the body 102 for connecting to an aerosol can 105 as generally known within the industry.

Figure 3:
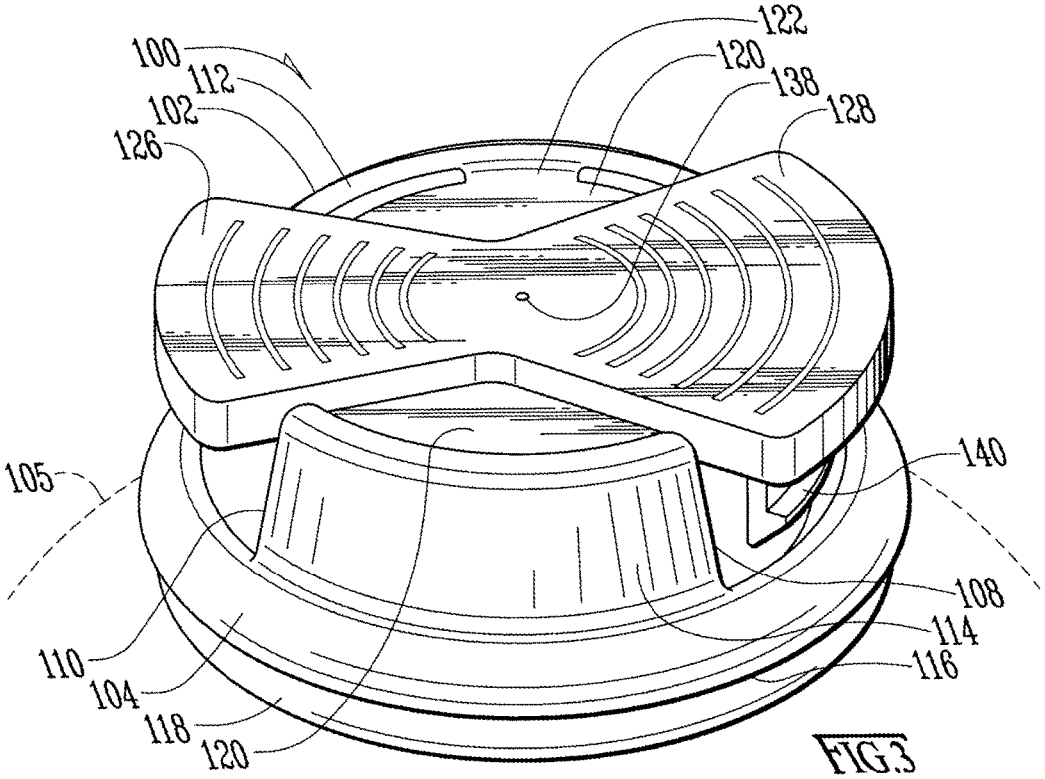
FIG. 3 illustrates a perspective view of the aerosol lever assembly of FIG. 1.

Within the central well 106 of the actuator body 102 an actuator disk 120 is provided. As best shown in FIGS. 2 and 3, the actuator disk 120 is connected to the inner periphery of the sidewall 114 with a first hinge 122 opposite a second hinge 124. The hinges 122 and 124 may be pins but are preferably formed integrally with the disk 120 and wall 114 during the manufacturing process. Further, the hinges 122 and 124 are flexible and allow the disk 120 limited rotation along an axis aligned with the lever notches 108, 110.

Figure 7:
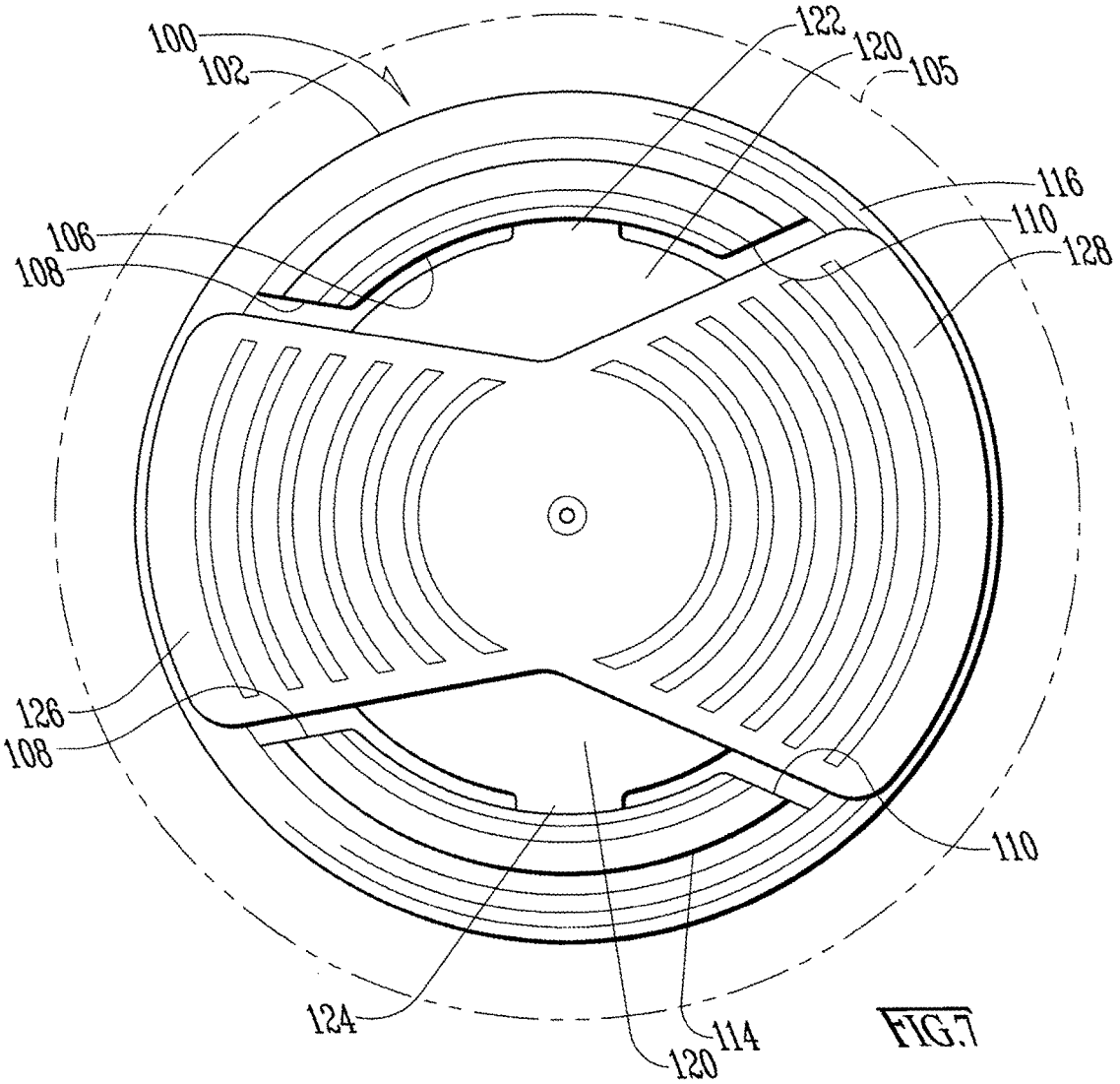
FIG. 7 is a partial top view of the aerosol lever assembly of FIG. 1.

The actuator disk 120 also has two opposing levers 126 and 128 formed integrally with the actuator disk 120 and generally extending outward from the disk toward and through the two lever notches 108, 110 as shown in FIG. 7. The two opposing levers comprise a first or spraying lever 126 and a second or fogging lever 128. One of the two levers should be larger than the other so that they are visually distinguishable. In the preferred embodiment, the spraying lever 126 is larger than the fogging lever 128.

Figure 4:
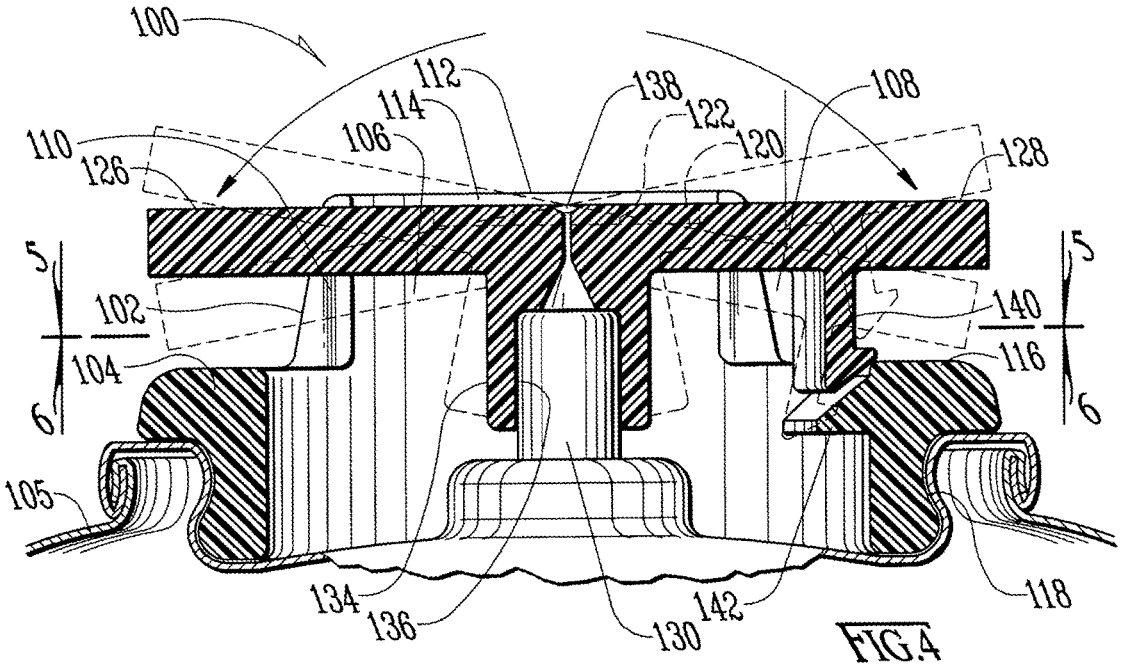
FIG. 4 is a cross sectional view taken along line 4-4 of FIG. 2.
Figure 5:
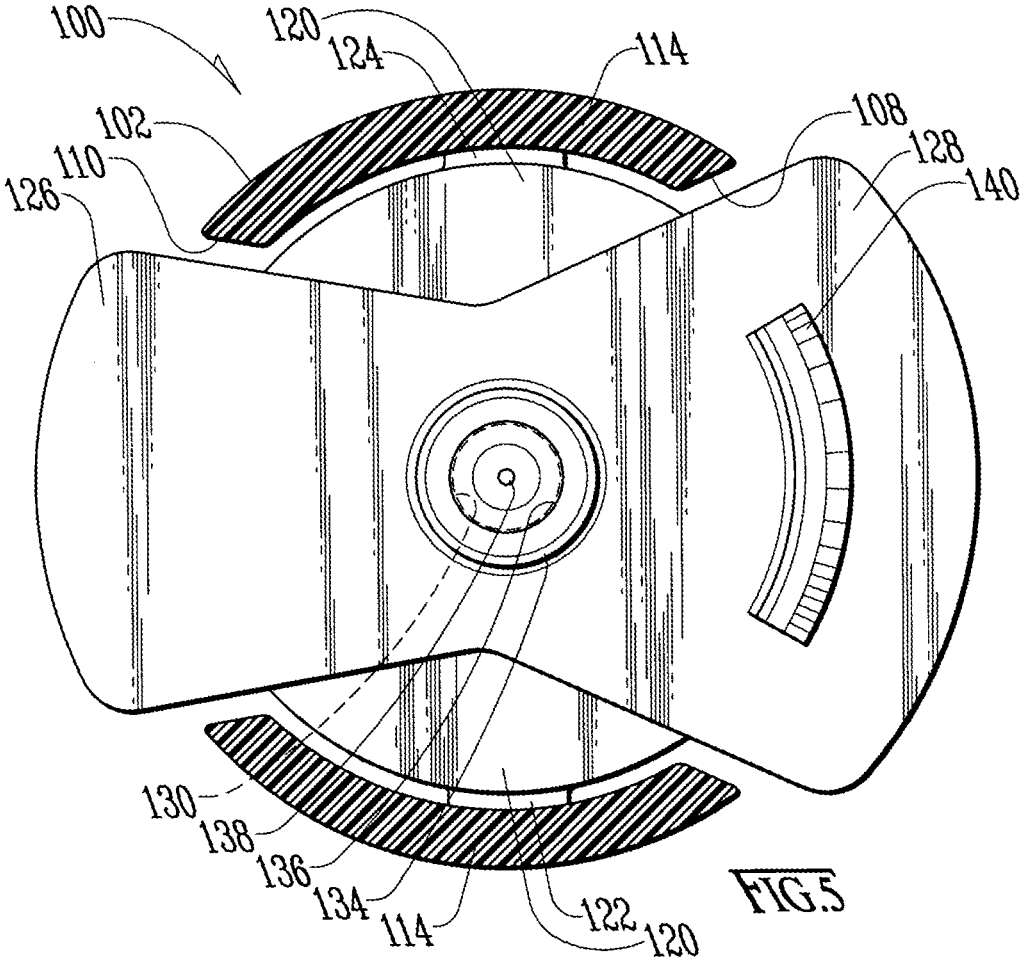
FIG. 5 is a top plan view of the aerosol lever assembly of FIG. 1.

As best shown in FIGS. 3 and 5, both the spraying lever 126 and fogging lever 128 may extend beyond the actuator body 102 and are generally oriented through the spaces created at the opposing lever notches 108, 110. The actuator disk 120 extends across the top of the aerosol can 105 and a protruding valve stem 130 provided on the can. Referring generally to the figures, and specifically to FIG. 4, on the bottom 132 of the actuator disk 120, substantially at the midpoint between the spraying lever 126 and fogging lever 128, a valve stem guide 134 and valve stem socket 136 are provided. The valve stem guide 134 aligns the actuator disk 120 with the valve stem 130 provided on the can 105 and the valve stem socket 136 connects with the valve stem. The valve stem guide 134 and valve stem socket 136 are oriented substantially above the valve stem of the can 105 when the actuator body 102 is connected to the can 105 with the mounting collar 116. A port 138 is formed transversely through the actuator disk 120 above the valve stem socket 136 to create a passage through the disk 120, such that fluid passing through the valve stem 130 exits the actuator through the port 138. Importantly, the port 138 aligns with the valve stem 130 which is generally provided at the center point of the can 105 and the port 138 is equidistance between the hinges 122, 124 and at the middle of the actuator disc 120 at the juncture of the levers 126, 128. The valve stem socket 138 connects the valve stem 130 and the port 138.

When the spraying lever 126 is pushed generally downward, the hinges 122, 124 allow the actuator disc 120 to rotate so that the valve stem socket 136 is forced downward onto the valve stem 130 which in turn releases pressurized fluid from within the can 105. Fluid passes through the valve stem 130, through the valve stem socket 136 and out of the port 138. The range of downward travel of the spraying lever 126 is limited by the size of the first lever notch 108. When the spraying lever 126 is released the hinges 122, 124 urge it back into its static position and pressure is removed from the valve stem 130 thereby stopping the discharge of fluid from the can 105.

Figure 6:
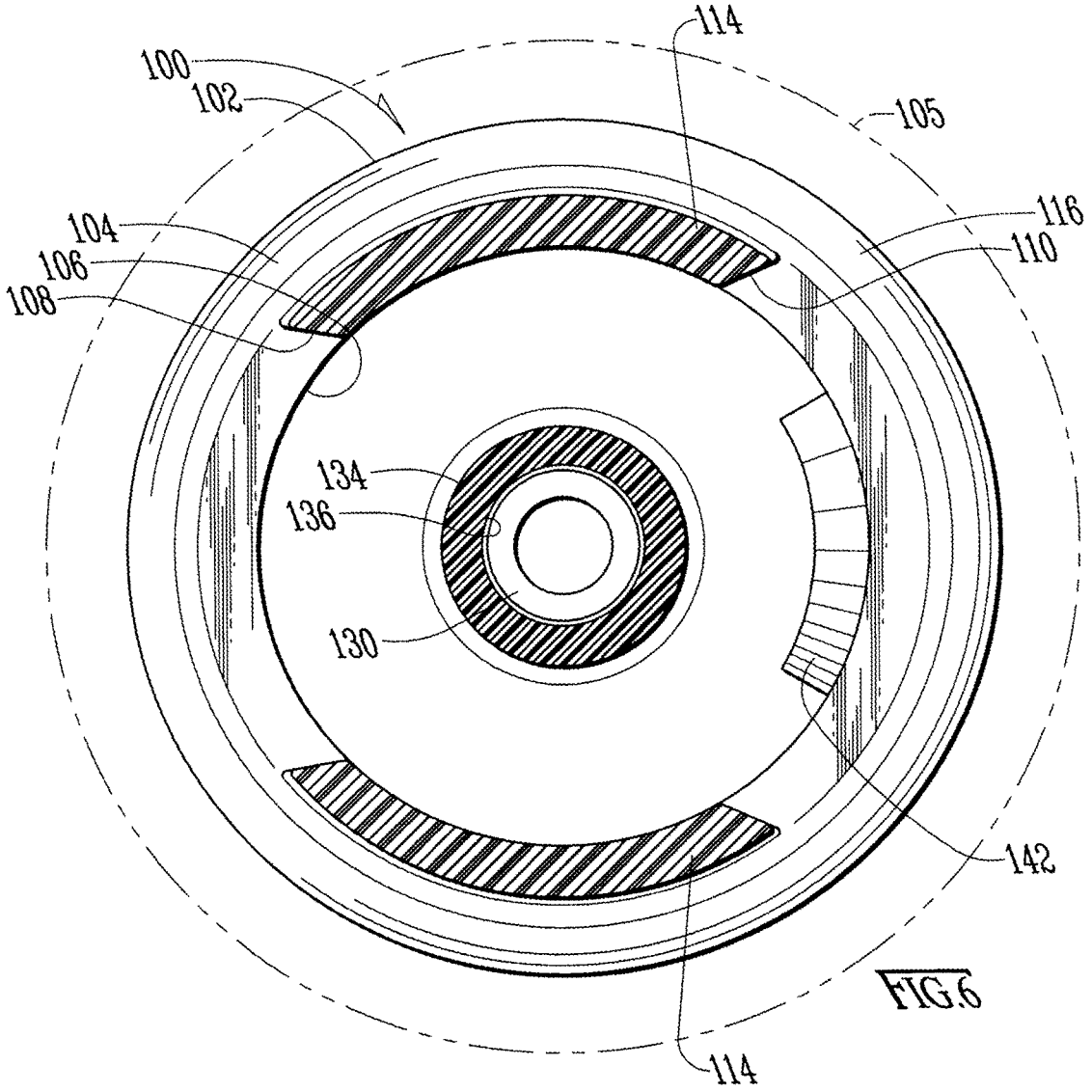
FIG. 6 is a partial cut-away of a top view of the aerosol lever assembly of FIG. 1.

Similarly, when the fogging lever 128 is depressed, entire actuator disk tilts at the axis of the hinges 122, 124 so that the valve stem socket 136 is forced downward onto the valve stem 130 which in turn releases pressurized fluid from within the can 105. Fluid passes through the valve stem 130, through the valve stem socket 136 and out of the port 138. The range of downward travel of the fogging lever 128 is limited by the size of the second lever notch 110. On the bottom of the actuator disc 120 at the outer edge of the fogging lever 128 a small, half spherical shaped catching member 140 is provided. A latch 142 is formed at the edge of the second lever notch 110 oriented generally below the fogging lever 128 and substantially aligned with the catching member 140 as shown in FIGS. 4, 5 and 6. The latch 142 is deformable and bends as the catching member 140 engages the latch 142 when the fogging lever 128 is forced downward into contact with the second lever notch 110. As the latch 142 deforms the catching member 140 passes below the latch 142 and is captured as the latch 142 returns to its normal, non-deformed condition. Because the catching member 140 becomes trapped below the latch 142, the fogging lever 128 is maintained in the depressed or active position and the force of the valve stem socket 136 against the valve stem 130 is maintained without mechanical downward force against the fogging lever 128. In this "locked" condition, force against the valve stem 130 results in the continuous release of fluid through the port 138.

Because both the spraying lever 126 and fogging lever 128 are integrally formed with the actuator disk 120, when one of the levers is depressed, the opposing lever necessarily elevates. Accordingly, when the fogging lever 128 is depressed and the catching member 140 is engaged by and captured under the latch 142, the spraying lever 126 is slightly elevated above the normal resting plane of the actuator disk 120. The catching member 140 can be disengaged from the 142 latch by forcing the spraying lever 126 downward which reverses the latching process. The catching member 140 is forced upward by downward pressure on the spraying lever 126 as the actuator disc 120 is rotated about the hinges 122, 124 by this downward pressure. Sufficient force can be achieved to cause the catching member 140 to slightly deform the latch 142 allowing the catching member 140 to move upward and past the latch 142, thereby unlatching the fogging lever 128 from the second lever notch 110 which stops the downward pressure against the valve 130 to stop the expulsion of fluid from the can.

In the event that fogging lever 128 is accidently pushed into the "locked" position, or if a user decides to discontinue fogging after commencing, the fogging lever 128 is unlocked by depressing the spraying lever 126, as described herein which, in turn, discontinues the expulsion of fluid from the valve stem. This inventive lever assembly allows a user to release controlled amounts of pressurized fluid by using the spraying lever, to release the entire contents of the can by depressing and locking the fogging lever, or prematurely discontinuing the complete discharge of the can by unlocking a fully depressed and locked fogging lever by depressing the spraying lever to disengage the catching member of the fogging lever from the latch.

Comprise, include, and/or plural forms of each are open ended and include the listed parts and can include additional parts that are not listed. And/or is open ended and includes one or more of the listed parts and combinations of the listed parts.

Importantly, the inventive assembly can be configured in many sizes for fitting pressurized containers of practically any size and configuration. Moreover, the device can be manufactured from a variety of materials or combination of materials without departing from the scope of this patent. One skilled in the art will realize that the present disclosure may be embodied in other specific forms without departing from the spirit or essential characteristics thereof. The foregoing embodiments are therefore to be considered in all respects illustrative rather than limiting of the present disclosure. Scope of the present disclosure is thus indicated by the appended claims, rather than by the foregoing description, and all changes that come within the meaning and range of equivalency of the claims are therefore intended to be embraced therein.

What is claimed is:

1. An actuator assembly for an aerosol can dispenser, comprising:

an actuator body having a peripheral wall defining an open well, and a mounting collar for fastening the actuator assembly to the aerosol can;

a first lever notch and an opposed second lever notch, each formed in the periphery of the actuator body;

an actuator disc having a top surface and bottom surface fastened to the peripheral wall by at least one hinge and generally oriented substantially within the center of the open well;

a first lever integrally formed with the actuator disc and oriented perpendicular the at least one hinge and toward the first lever notch;

a second lever integrally formed with the actuator disc opposite to and generally aligned with the first lever and toward the second lever notch;

a port through the actuator disc providing a passage between the top surface and bottom surface oriented substantially between the first lever and second lever;

a valve stem socket attached to the bottom surface of the actuator disc and aligned with the port for connection to a valve stem provided on the aerosol can and whereby downward force against the valve stem socket causes pressure on the valve stem sufficient to discharge pressurized fluid from the aerosol can and through the port.

2. The actuator assembly of claim 1, wherein the second lever further comprises:

a top, a bottom and an edge positioned substantially within the second lever notch;

a catching member is provided on the bottom of the second lever near the edge and aligned with a deformable latch provided at the second lever notch; and wherein downward pressure on the top of the second lever causes the catching member to engage and partially deform the latch such that the catching member passes generally downward past the latch whereupon the latch reforms and captures the catching member below the latch to secure the second lever in a depressed position causing the continuous expression of fluid from the aerosol can.

3. The actuator assembly of claim 1, further comprising a latch provided on the wall below the second lever, a catching member formed on the second lever near the latch, and wherein upon depressing the second lever the catching member engages and is retained by the latch.

4. The actuator assembly of claim 3 wherein the catching member is deformable and is disengaged from the latch by applying upward force to the second lever.

5. The actuator assembly of claim 4 wherein the catching member is disengaged from the latch by applying downward pressure to the first lever.

6. A method for selectively spraying liquid from an aerosol can fitted with the actuator assembly of claim 2, comprising the steps of:

forcibly depressing the first lever for a desired period of time to engage the valve stem socket with the valve stem of the aerosol can thereby dispersing the fluid through the port or forcibly depressing the second lever to engage the catching member to the latch to continuously engage the valve stem socket with the valve stem of the aerosol can thereby dispersing the fluid through the port without exerting continuous manual pressure on second lever.

7. The method of claim 6 adding the step of releasing the catching member of the second lever from the latch by forcibly depressing the first lever.

8. An actuator assembly for an aerosol can dispenser, comprising:

an actuator body having a peripheral wall defining an open well, and a mounting collar for fastening the actuator assembly to the aerosol can;

a first lever notch and an opposed second lever notch, each formed in the periphery of the actuator body;

an actuator disc having a top surface and bottom surface moveably connected to the peripheral wall by a pair of hinges and generally oriented substantially within the center of the open well;

a first lever integrally formed with the actuator disc and oriented perpendicular the at least one hinge and through the first lever notch;

a second lever integrally formed with the actuator disc opposite to and generally aligned with the first lever and through the second lever notch;

a port through the actuator disc providing a passage between the top surface and bottom surface oriented substantially between the first lever and second lever;

a valve stem socket attached to the bottom surface of the actuator disc and aligned with the port for connection to a valve stem provided on the aerosol can and whereby downward force against the valve stem socket causes pressure on the valve stem sufficient to discharge pressurized fluid from the aerosol can and through the port.

9. The actuator assembly of claim 8, wherein the second lever further comprises:

a top, a bottom and an edge positioned substantially within the second lever notch;

a catching member is provided on the bottom of the second lever near the edge and aligned with a deformable latch provided at the second lever notch; and wherein downward pressure on the top of the second lever causes the catching member to engage and partially deform the latch such that the catching member passes generally downward past the latch whereupon the latch reforms and captures the catching member below the latch to secure the second lever in a depressed position causing the continuous expression of fluid from the aerosol can.

10. The actuator assembly of claim 8, further comprising a latch provided on the wall below the second lever, a catching member formed on the second lever near the latch, and wherein upon depressing the second lever the catching member engages and is retained by the latch.

11. The actuator assembly of claim 10 wherein the catching member is deformable and is disengaged from the latch by applying upward force to the second lever.

12. The actuator assembly of claim 11 wherein the catching member is disengaged from the latch by applying downward pressure to the first lever.

13. A method for selectively spraying liquid from an aerosol can fitted with the actuator assembly of claim 9, comprising the steps of:

forcibly depressing the first lever for a desired period of time to engage the valve stem socket with the valve stem of the aerosol can thereby dispersing the fluid through the port or forcibly depressing the second lever to engage the catching member to the latch to continuously engage the valve stem socket with the valve stem of the aerosol can thereby dispersing the fluid through the port without exerting continuous manual pressure on second lever.

14. The method of claim 13 adding the step of releasing the catching member of the second lever from the latch by forcibly depressing the first lever.

* * * * *